US005157383A

United States Patent [19]

Fisher

[11] Patent Number: 5,157,383

[45] Date of Patent: Oct. 20, 1992

[54] REMOTE RESPONSIVE SYSTEM

[76] Inventor: Eldridge Fisher, 1244 Serenade La., Dallas, Tex. 75241

[21] Appl. No.: 719,634

[22] Filed: Jun. 24, 1991

[51] Int. Cl.[5] ..... G08B 13/00

[52] U.S. Cl. ..... 340/574; 340/538; 341/176

[58] Field of Search ..... 340/574, 539, 538, 573, 340/326, 693; 455/53-56; 341/176

[56] References Cited

U.S. PATENT DOCUMENTS 4,189,721 2/1980 Doell ..... 340/539
4,719,454 1/1988 Hopkins et al. ..... 340/574
4,755,792 7/1988 Pezzolo et al. ..... 340/538
4,764,757 8/1988 DeMarco et al. ..... 340/574
4,996,517 2/1991 Kringen et al. ..... 340/538 X
4,998,095 3/1991 Shields ..... 340/574

*Primary Examiner*—Jin F. Ng
*Assistant Examiner*—Thomas J. Mullen, Jr.
*Attorney, Agent, or Firm*—Richard C. Litman

[57] ABSTRACT

Disclosed is a remote responsive system for warning security personnel or other individuals. The system includes a receiver unit, which is responsive to a remote power switching device, for controlling both a visual and audio warning device. A transmit unit includes the remote responsive power switch for supplying power to the receiver location. The remote power switcher is controlled by a hand-held remote transmitter.

9 Claims, 1 Drawing Sheet

REMOTE RESPONSIVE SYSTEM

FIELD OF THE INVENTION

The present invention discloses a remote responsive system which may used to warn individuals of impending harm or concern. When a person feels that his or her life may be in danger, that person may activate a remote transmitter which in turn controls a remote responsive switch. The present invention may be used by the sick and shut-in, by children to alert their parents, by teachers to signal security personnel, etc.

DESCRIPTION OF THE RELATED ART

Attempts have been made to make a remote responsive system that may used by individuals to alert others. Such attempts are shown in U.S. Pat. Nos. 1,559,312; 3,668,682; 4,237,344; 4,418,334; and 4,730,184 issued to Cadieux, Barbee et al., Moore, Burnett and Bach respectively. More specifically U.S. Pat. No. 4,730,184 discloses a remote control for controlling an alarm unit at a different location. None of the patents disclose nor suggest applicant's invention of having a receiver unit being placed at a first location, a transmitter unit being placed at a second location remotely removed from the first location and a remote transmitter for controlling the transmitter unit, wherein the receiver unit receives an AC voltage from the transmitter unit.

SUMMARY OF THE INVENTION

The present invention relates to a remote responsive system that gives a user the ability to alert others that their attention is required. The system uses a remote transmitter to control a transmitter unit which in turn controls a receiver unit.

An object of the present invention is to provide a remote transmitter with the ability to control a transmitter unit.

A further object of the present invention is to provide a receiver unit that is responsive to a transmitter unit.

Another object of the present invention is to provide a receiver unit with warning means to alert the required personnel.

A still further object of the present invention is to provide a receiver unit with a power transfer switch which controls the warning means.

Yet another object of the present invention is to provide a transmitter unit with a remote responsive power switch.

These and other objects regarding the features on the instant invention will become apparent to those skilled in the art, such as, providing a transmitter unit that controls a receiver unit by electromagnetic waves.

DESCRIPTION OF THE PREFERRED EMBODIMENT

Figure 1:
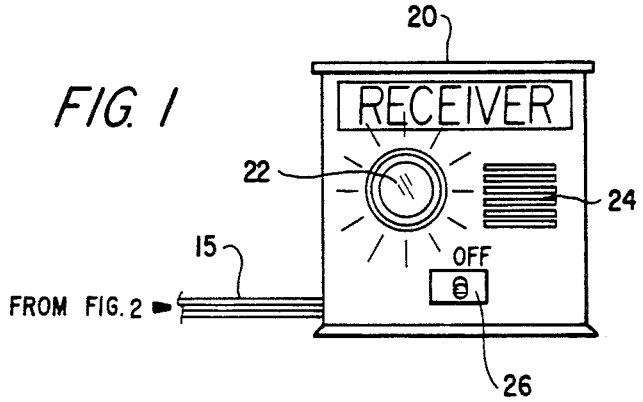
FIG. 1 shows the receiver unit.

Referring to FIG. 1, there is shown a receiver unit 20 that includes a warning light 22 and a warning speaker 24. The unit 20 further includes an OFF switch 26 to turn off the unit when activated from a transmitter location. The unit 20 receives an AC voltage on line 15. Inside the receiver unit 20, there is a transfer power switch that receives the AC voltage. The transfer power switch further includes circuit elements, to change the AC voltage to a DC voltage, and to turn off the supply of voltage, by the OFF switch 26, when an AC voltage is present. This may include the use of a voltage converter transformer and a reset circuit to turn off the supply of voltage.

Figure 2:
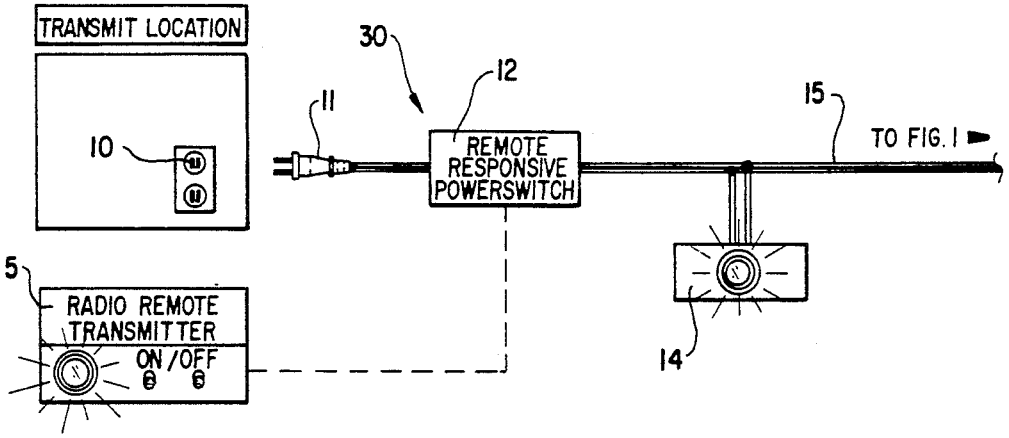
FIG. 2 shows the transmitter unit.

FIG. 2 shows the elements of a transmitter unit 30 being located at remote location from the receiver unit 20. A power plug 11 plugs into a wall outlet 10 and supplies an AC voltage to a remote responsive power switch 12. Connected to the remote responsive power switch 12 is line 15 and a signalling light 14. When the remote responsive power switch 12 passes the AC voltage to line 15, signalling light 14 turns on and the transfer power switch inside the receiver unit supplies a voltage to the warning lights and speakers. A radio remote transmitter 5 has a light 6, an ON switch 7 and an OFF switch 8. The transmitter 5, when activated, sends out a radio signal to control the remote responsive power switch 12. The remote 5 may turn on or off the remote responsive power switch 12.

The operation of the remote responsive system will now be explained with reference to FIGS. 1 and 2. When a person feels that his or her life may be in danger inside of a building, that person may activate the remote transmitter 5. The transmitter 5 can be located in a office remote from the receiver unit 20. However the remote responsive switch 12 is within range of the transmitter 5. This is to insure that the receiver unit 20 can warn the appropriate security personnel. The remote responsive power switch 12, once activated by the remote transmitter 5, passes the AC voltage to the receiver unit 20. The receiver unit 20, once it receives the AC voltage, passes this voltage through a transfer power switch, which activates the warning devices. The warning devices may include a telephone link to the police 911 emergency number. The system of FIGS. 1 and 2 is a portable system that can be moved from room to room or from building to building. In a preferred embodiment, the length of the line 15 may be as short as five feet or as long as one thousand feet.

Figure 3:
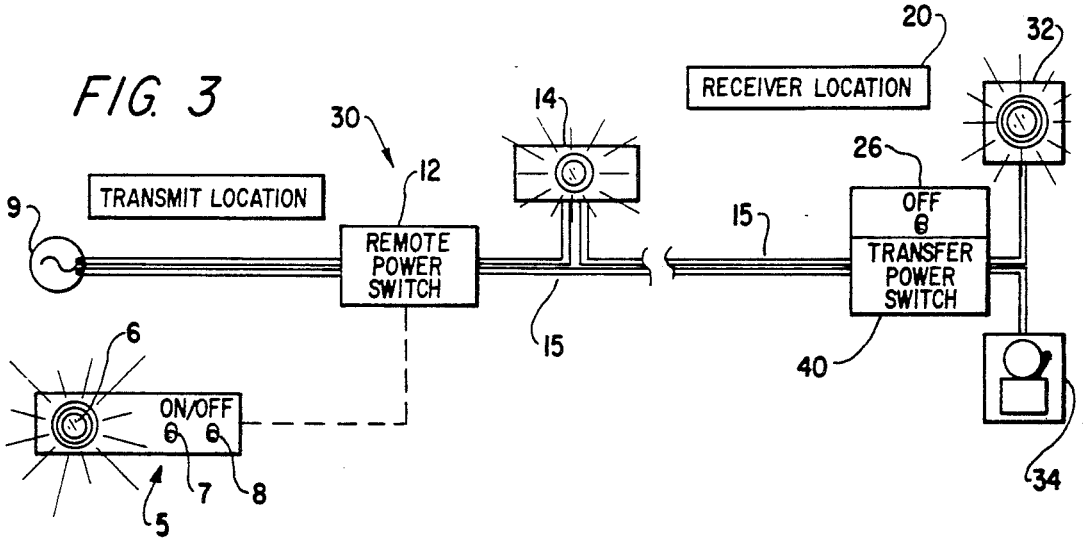
FIG. 3 shows an alternative layout for both the receiver and transmitter units.

FIG. 3 shows an example of the remote responsive system that receives its AC voltage direct from an AC source. For example the source may be the building transformer or circuit breaker box. Further shown in FIG. 3 are the elements which make up the transmitter unit 30'. The transmitter unit 30' elements comprise of the remote transmitter 5, the remote power switch 12 and a signalling light 14, all of which operate in the same manner as shown and described with reference to FIG. 2. Still further shown in FIG. 3 are the elements that make up the receiver unit 20'. The elements of the receiver unit 20' are a transfer power switch 40/OFF switch 26, a warning light 32 and a warning speaker 34, all of which have already been described with reference to FIGS. 1 and 2.

Although the instant invention has been described with respect to specific details of certain preferred embodiments thereof, it is not intended that such details limit the scope of the instant invention, except insofar as is set forth in the following claims.

I claim:

1. A remote responsive system comprising:

a receiver unit being placed at a first location, said received unit contains warning means;

a transmitter unit being placed at a second location remotely removed from said first location, said transmitter unit contains a remote responsive power switch;

said remote responsive power switch is controlled by a hand held remote transmitter;

said receiver unit further contains a power transfer switch being responsive to an off switch;

whereby, when said hand held remote transmitter activates said remote responsive power switch, an AC voltage is passed through said remote responsive power switch to said receiver unit.

2. A remote responsive system as defined in claim 1 further comprising lamp means being responsive to said hand held remote transmitter.

3. A remote responsive system as defined in claim 2 wherein said hand held remote transmitter contains control switching means.

4. A remote responsive system as defined in claim 3 wherein said control switching means are on and off switches.

5. A remote responsive system as defined in claim 1 wherein said warning means include both visual and audio signalling devices.

6. A portable remote responsive system comprising:

a receiver unit being placed at a first location, said receiver unit contains warning means;

a transmitter unit being placed at a second location remotely removed from said first location, said transmitter unit contains a remote responsive power switch;

said remote responsive power switch is controlled by a hand held remote transmitter;

said receiver unit further contains a power transfer switch being responsive to an off switch;

whereby, when said hand held remote transmitter activates said remote responsive power switch, an AC signal is passed through said remote responsive power switch to said receiver unit.

7. A portable remote responsive system as defined in claim 6 further comprising lamp means being responsive to said hand held remote transmitter.

8. A portable remote responsive system as defined in claim 7 wherein said hand held remote transmitter contains control switching means.

9. A portable remote responsive system as defined in claim 6 wherein said warning means include both visual and audio signalling devices.

* * * * *